US009691332B2

(12) United States Patent
Li et al.

(10) Patent No.: US 9,691,332 B2
(45) Date of Patent: Jun. 27, 2017

(54) METHOD AND DEVICE FOR ADJUSTING BACKLIGHT BRIGHTNESS

(71) Applicant: Xiaomi Inc., Beijing (CN)

(72) Inventors: Guosheng Li, Beijing (CN); Anyu Liu, Beijing (CN); Wei Feng, Beijing (CN)

(73) Assignee: XIAOMI INC., Haidian District, Beijing (CN)

( * ) Notice: Subject to any disclaimer, the term of this patent is extended or adjusted under 35 U.S.C. 154(b) by 51 days.

(21) Appl. No.: 14/710,614

(22) Filed: May 13, 2015

(65) Prior Publication Data

US 2016/0063927 A1 Mar. 3, 2016

Related U.S. Application Data

(63) Continuation of application No. PCT/CN2015/071357, filed on Jan. 22, 2015.

(30) Foreign Application Priority Data

Aug. 26, 2014 (CN) ..... 2014 1 0423129

(51) Int. Cl.
*H05B 37/02* (2006.01)
*G09G 3/34* (2006.01)

(52) U.S. Cl.
CPC ... *G09G 3/3406* (2013.01); *G09G 2320/0238* (2013.01); *G09G 2320/0626* (2013.01)

(58) Field of Classification Search
CPC ..... G09G 3/3406; G09G 2320/0238; G09G 2320/0626
USPC ..... 315/297, 151, 152; 348/790; 345/694, 345/89
See application file for complete search history.

(56) References Cited

U.S. PATENT DOCUMENTS

2010/0103342 A1* 4/2010 Park ..... G02B 6/0068 349/61
2013/0015770 A1* 1/2013 Aitken ..... G09G 3/3406 315/154

* cited by examiner

*Primary Examiner* — Daniel D Chang
(74) *Attorney, Agent, or Firm* — Jun He Law Offices P.C.; James J. Zhu

(57) ABSTRACT

The present disclosure provides a backlight brightness control method and a device for adjusting brightness of a backlight. The method comprises: receiving a control instruction to adjust a current brightness value to a target brightness value; stopping current supply to backlights of a first backlight assembly, determining a first target current value necessary for backlights of a second backlight assembly to reach the target brightness value, and providing the first target current value to the backlights of the second backlight assembly, when the current brightness value is greater than a first threshold and the target brightness value is less than the first threshold.

17 Claims, 2 Drawing Sheets

METHOD AND DEVICE FOR ADJUSTING BACKLIGHT BRIGHTNESS

CROSS-REFERENCE TO RELATED APPLICATIONS

This application is a Continuation application of International Application No. PCT/CN2015/071357, filed with the State Intellectual Property Office of P. R. China on Jan. 22, 2015, which is based on and claims priority to Chinese Patent Application No. 201410423129.3, filed on Aug. 26, 2014, the entire contents of which are incorporated herein by reference.

FIELD

The present disclosure relates to a field of electronic technology, and more particularly, to a method and device for adjusting brightness of a backlight.

BACKGROUND

Smart devices are often used in a low lighting environment in daily life. The light emitted from a backlight of an smart device may be harsh on a user's eyes when the ambient light is weak, so the user will turn down the brightness of the backlight, such that the backlight of the smart device will emit light with lower brightness to adapt to the environment. However, even if the brightness of the backlight of the smart device has been adjusted to a minimum brightness, the user may still feel harsh when using the smart device in a dark place.

In the related art, the current provided by a control chip of a terminal device to the backlight is in direct proportion to the brightness of the backlight, so the current supplied to the backlight of the smart device is decreased in order to gain a lower brightness. However, if the brightness of the backlight is turned down only by reducing the current supplied to the backlight, the signal-noise ratio of the control chip for providing current to the backlight is rather low when the current supplied to the backlight is reduced to a certain extent, such that the control chip is considerably influenced by external noise. Consequently, when the user sets a fixed ultralow brightness for the smart device, the control chip of the smart device may be subject to external noise interference, and hence the current outputted from the control chip to the backlight may be unstable. When the backlight receives an unstable current supply, the brightness of the backlight flickers as the current outputted from the control chip varies, and thus the backlight cannot be kept at a fixed low brightness. Flickering of the backlight of the smart device at a low brightness not only degrades user experiences, but also reduces the life of the backlight due to current instability.

SUMMARY

Accordingly, the present disclosure provides a method and device for adjusting brightness of a backlight, such that the backlight of an smart device can stably emit light with ultralow brightness.

According to a first aspect of embodiments of the present disclosure, there is provided a method for adjusting the brightness of a backlight in a terminal device, comprising: receiving a control instruction to adjust a current brightness value to a target brightness value; stopping current supply to backlights of a first backlight assembly, determining a first target current value necessary for backlights of a second backlight assembly to reach the target brightness value, and providing the first target current value to backlights of the second backlight assembly, when the current brightness value is greater than a first threshold and the target brightness value is less than the first threshold, wherein the terminal device comprises the first backlight assembly and the second backlight assembly, each of which comprises a plurality of backlights, and the terminal device supplies current to the backlights of the first backlight assembly and the backlights of the second backlight assembly.

According to a second aspect of embodiments of the present disclosure, there is provided a device for adjusting brightness of a backlight in a terminal device, comprising: a processor, a memory configured to store an instruction executable by the processor, wherein the processor is configured to perform: receiving a control instruction to adjust a current brightness value to a target brightness value; stopping current supply to backlights of a first backlight assembly; determining a first target current value necessary for backlights of a second backlight assembly to reach the target brightness value; and providing the first target current value to the backlights of the second backlight assembly, when the current brightness value is greater than a first threshold and the target brightness value is less than the first threshold, wherein the terminal device comprises the first backlight assembly and the second backlight assembly, each of which comprises a plurality of backlights, and the terminal device supplies current to the backlights of the first backlight assembly and the backlights of the second backlight assembly.

According to a third aspect of embodiments of the present disclosure, there is provided a non-transitory computer-readable storage medium having stored therein instructions that, when executed by a processor of a terminal device, causes the terminal device to perform a method for adjusting brightness of a backlight, the method comprising: receiving a control instruction to adjust a current brightness value to a target brightness value; stopping current supply to backlights of a first backlight assembly; determining a first target current value necessary for backlights of a second backlight assembly to reach the target brightness value; and providing the first target current value to the backlights of the second backlight assembly, when the current brightness value is greater than a first threshold and the target brightness value is less than the first threshold, wherein the terminal device comprises the first backlight assembly and the second backlight assembly, each of which comprises a plurality of backlights, and the terminal device supplies current to the backlights of the first backlight assembly and the backlights of the second backlight assembly.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the disclosure. Instead, they are merely examples of apparatuses and methods consistent with some aspects related to the disclosure as recited in the appended claims.

Figure 1:
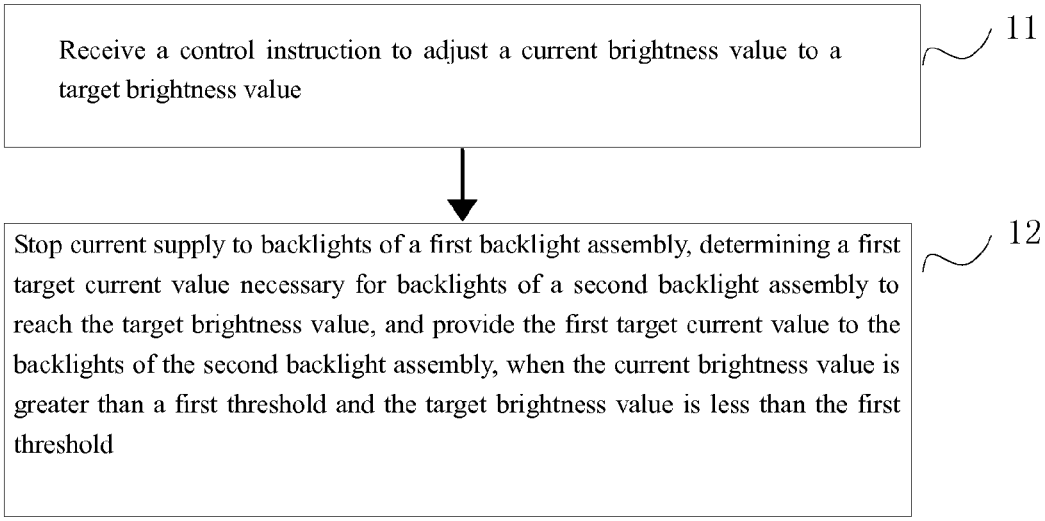
FIG. 1 is a flow chart of a method for adjusting brightness of a backlight according to an exemplary embodiment.

FIG. 1 is a flow chart of a method for adjusting brightness of a backlight according to an exemplary embodiment. Referring to FIG. 1, the method for adjusting brightness of a backlight illustrated in FIG. 1 may be applied to a terminal device including a first backlight assembly and a second backlight assembly, each of which may include a plurality of backlights, and the terminal device provides current for the backlights of the first backlight assembly and the backlights of the second backlight assembly. The method according to the present disclosure enables a backlight to stably emit light with ultralow brightness. The method includes the following steps.

In step 11, a control instruction to adjust a current brightness value to a target brightness value is received.

The screen of the terminal device is equipped with the first backlight assembly and the second backlight assembly therein. When the terminal device supplies current to the first backlight assembly and the second backlight assembly respectively, the plurality of backlights comprised in the first backlight assembly and the second backlight assembly emit light to illuminate the screen, and hence a user can see the content on the screen. Normally, when receiving the control instruction, the terminal device determines a current value corresponding to the target brightness value, and provides the first backlight assembly and the second backlight assembly with the current value, such that the plurality of backlights of the first backlight assembly and the second backlight assembly emit light corresponding to the target brightness value.

In addition, the control instruction received by the terminal device may be triggered manually by the user. For example, if the user is not satisfied with the current brightness value of the screen of the terminal device, the user may press a button of the terminal device or touch the screen, so as to input a control instruction to adjust the current brightness value to a target brightness value to the terminal device. The control instruction received by the terminal device may also be triggered by a sensor within the terminal device in a particular situation. For instance, if the brightness of the ambient light collected by a light sensor in the terminal device is less than a certain threshold, the light sensor will send the control instruction to adjust the current brightness value to the target brightness value to the terminal device.

In addition, the current brightness value is the brightness value of the screen of the terminal device at present, and the target brightness value is the brightness value after adjustment. If the brightness value of the screen of the terminal reaches the maximum, it means that the terminal device provides a maximum rated working current for the backlights of the first backlight assembly and the backlights of the second backlight assembly; if the brightness value of the screen of the terminal device reaches the minimum, it means that the terminal device provides a minimum rated working current for the backlights of the first backlight assembly and the backlights of the second backlight assembly. For example, the brightness value of the screen of the terminal device is represented by percentage, and the rated working current that the terminal device provides for the backlights of the first backlight assembly and the backlights of the second backlight assembly is supposed to range from 1 to 20 mA. The terminal device may provide the backlights of the first backlight assembly and the backlights of the second backlight assembly with a current of 20 mA when the brightness value is 100 percent, a current of 1 mA when the brightness value is 5 percent, and a current of 10 mA when the brightness value is 10 percent.

In step 12, the current supply to the backlights of the first backlight assembly is stopped, a first target current value necessary for the backlights of the second backlight assembly to reach the target brightness value is determined, and the first target current value is provided to the backlights of the second backlight assembly, when the current brightness value is greater than a first threshold and the target brightness value is less than the first threshold.

The first threshold is a preset brightness value, and will vary with the number of the backlights of the screen of the terminal device and the range of the rated working current of the backlights. The first threshold is a critical point between the operation of a single backlight assembly and the operation of two backlight assemblies. When the target brightness value is larger than or equal to the first threshold, the backlights of the first backlight assembly and the backlights of the second backlight assembly work simultaneously; when the target brightness value is less than the first threshold, either the backlights of the first backlight assembly or the backlights of the second backlight assembly work. If the current brightness value is greater than the first threshold and the target brightness value is less than the first threshold, it means that the terminal device is providing current to the backlights of the first backlight assembly and the backlights of the second backlight assembly simultaneously, but one of the two backlight assemblies needs to be turned off, such that it is possible to avoid the flickering or unstable brightness of the light emitted from the backlights caused by a relatively low current supply due to a smaller target brightness value.

In addition, after stopping current supply to the backlights of the first backlight assembly, the terminal device determines a first target current value necessary for the backlights of the second backlight assembly to reach the target brightness value. The number of the backlights of the second backlight assembly is known, so are the brightness emitted by each backlight per milliampere and the target brightness value, such that the first target current value necessary for the target brightness value can be determined, according to formula (A): "number of backlights×target current value× brightness value per milliampere of each backlight=target brightness value".

In the following, examples are provided to illustrate the solution of the present disclosure. For example, the brightness value of the screen of the terminal device is represented by percentage, and the rated working current that the terminal device provides for the backlights of the first backlight assembly and the backlights of the second backlight assembly is supposed to range from 1 to 20 mA. When the terminal device provides a current less than 1 mA to the backlights of the first backlight assembly and the backlights of the second backlight assembly, the backlights may flicker, or the brightness of the backlights may be unstable. The number of backlights in the first backlight assembly is six, the number of backlights in the second backlight assembly is six, the brightness per milliampere of each backlight is 0.4%, the current brightness value is 10%, the current value is 2 mA at present, and the target brightness value is 3.75%. According to formula (A): "number of backlights×target current value×brightness value per milliampere of each backlight=target brightness value", the first threshold=number of backlights (12)×target current value (1 mA)×brightness value per milliampere of each backlights (0.4%)=4.8%, so the first threshold is 4.8%. The current brightness value 10% is larger than the first threshold 4.8%, and the target brightness value 3.75% is less than the first threshold 4.8%, so the current supply to the six backlights of the first backlight assembly needs to be stopped, and the first target current value necessary for the six backlights of the second backlight assembly to reach the target brightness value 3.75% needs to be determined. In order to calculate the first target current value, formula (B): "target current value=target brightness value÷(number of backlights× brightness value per milliampere of each backlight)" can be derived from formula (A): "number of backlights×target current value×brightness value per milliampere of each backlight=target brightness value", and according to formula (B), the target current value=target brightness value (3.75%)÷(number of backlights (6)×brightness value per milliampere of each backlights (0.4%))=1.56 mA. Thus, the terminal device will provide a target current of 1.56 mA to the six backlights of the second backlight assembly. Since the target current value 1.56 mA is larger than 1 mA, the light emitted from the six backlights in the second backlight assembly will not flicker, or the brightness of the light will not be unstable.

In the embodiment shown in FIG. 1, only the backlights of the second backlight assembly are provided with the target current value, and the current supply to the backlights of the first backlight assembly is stopped, when the target brightness value is less than the first threshold. Since the backlights of the first backlight assembly do not emit light, the resulting brightness loss needs to be compensated for by increasing the target current value supplied to the backlights of the second backlight assembly, so as to avoid interference of external noise due to a too low current supply. Therefore, the method according to the present disclosure enables the backlights to stably emit light with ultralow brightness.

In an alternative embodiment of the present disclosure, after step 11, the method provided in the present disclosure further includes the following steps: determining a second target current value necessary for the backlights of the first backlight assembly and the backlights of the second backlight assembly to reach the target brightness value together, and providing the second target current value to the backlights of the first backlight assembly and the backlights of the second backlight assembly simultaneously, when the current brightness value is less than a second threshold and the target brightness value is greater than the second threshold, the second threshold being equal to the first threshold. In this way, since the second threshold is equal to the first threshold, and the current brightness value is less than the second threshold and the target brightness value is greater than the second threshold, it means that at present the terminal device only provides current for the backlights of the first backlight assembly or the backlights of the second backlight assembly, so it is necessary to turn on the other backlight assembly to guarantee that the screen of the terminal device provides brightness according to the target brightness.

For example, the brightness value of the screen of the terminal device is represented by percentage, the terminal device is supposed to provide current to the backlights of the first backlight assembly only, and the rated working current that the terminal device provides for the backlights of the first backlight assembly and the backlights of the second backlight assembly is supposed to range from 1 to 20 mA. When the terminal device provides a current less than 1 mA to the backlights of the first backlight assembly and the backlights of the second backlight assembly, the backlights may flicker, or the brightness of the backlights may be unstable. The number of backlights in the first backlight assembly is six, the number of backlights in the second backlight assembly is six, the brightness per milliampere of each backlight is 0.4%, the brightness value is 3.75% at present; the current value is 1.56 mA at present, and the target brightness value is 10%. According to formula (A): "number of backlights×target current value×brightness value per milliampere of each backlight=target brightness value", the first threshold=number of backlights (12)×target current value (1 mA)×brightness value per milliampere of each backlight (0.4%)=4.8%, so the first threshold is 4.8%; the first threshold is equal to the second threshold, and hence the second threshold is 4.8%. Since the current brightness value 3.75% is less than the second threshold 4.8%, and the target brightness value 10% is greater than the second threshold 4.8%, so the second target current value necessary for the six backlights of the first backlight assembly and the six backlights of the second backlight assembly to reach the target brightness value 10% together needs to be determined, and the second target current value is provided to the six backlights of the first backlight assembly and the six backlights of the second backlight assembly. In order to calculate the second target current value, formula (B): "target current value=target brightness value÷(number of backlights× brightness value per milliampere of each backlight)" can be derived from formula (A): "number of backlights×target current value×brightness value per milliampere of each backlight=target brightness value," and according to formula (B), the target current value=target brightness value (10%)÷(number of backlights (12)×brightness value per milliampere of each lamp (0.4%))=2 mA. Thus, the terminal device will provide a target current of 2 mA to the six backlights of the first backlight assembly and the six backlights of the second backlight assembly. Since the target current value 2 mA is larger than 1 mA, the light emitted from the six backlights of the first backlight assembly and the six backlights of the second backlight assembly will not flicker, or the brightness of the light will not be unstable; further, it can be guaranteed that the screen of the terminal device can provide brightness according to the target brightness.

In an alternative embodiment of the present disclosure, after step 11, the method provided in the present disclosure further includes the following steps: determining a second target current value necessary for the backlights of the first backlight assembly and the backlights of the second backlight assembly to reach the target brightness value together, and providing the second target current value to the backlights of the first backlight assembly and the backlights of the second backlight assembly simultaneously, when the current brightness value is less than a second threshold and the target brightness value is greater than the second threshold, the second threshold being greater than the first threshold. In this way, since the second threshold is greater than the first threshold, and the current brightness value is less than the second threshold and the target brightness value is greater than the second threshold, which means that the terminal device only provides current for the backlights of the first backlight assembly or the backlights of the second backlight assembly, the other backlight assembly needs to be turned on to guarantee that the screen of the terminal device provides brightness according to the target brightness value. Further, a buffer zone is arranged between the first threshold and the second threshold, such that when the target brightness value falls into the buffer zone, the terminal device can remain the original control mode without frequently switching from a single backlight assembly to two backlight assemblies or the other way round.

For example, the brightness value of the screen of the terminal device is represented by percentage, the terminal device is supposed to provide current to the backlights of the first backlight assembly only, and the rated working current that the terminal device provides for the backlights of the first backlight assembly and the backlights of the second backlight assembly is supposed to range from 1 to 20 mA. When the terminal device provides a current less than 1 mA to the backlights of the first backlight assembly and the backlights of the second backlight assembly, the backlights may flicker, or the brightness of the backlights may be unstable. The number of backlight s in the first backlight assembly is six, the number of backlights in the second backlight assembly is six, the brightness per milliampere of each backlight is 0.4%, the brightness value is 3.75% at present, the current value is 1.56 mA at present, and the target brightness value is 10%. According to formula (A): "number of backlights×target current value×brightness value per milliampere of each backlight=target brightness value," the first threshold=number of backlights (12)×target current value (1 mA)×brightness value per milliampere of each backlight (0.4%)=4.8%, so the first threshold is 4.8%, and the second threshold is set at 8%. The brightness value 3.75% at present is less than the second threshold 8%, and the target brightness value 10% is greater than the second threshold 8%, so the second target current value necessary for the six backlights of the first backlight assembly and the six backlights of the second backlight assembly to reach the target brightness value 10% together needs to be determined, and the second target current value is provided to the six backlights of the first backlight assembly and the six backlights of the second backlight assembly simultaneously. In order to calculate the second target current value, formula (B): "target current value=target brightness value÷(number of backlights×brightness value per milliampere of each backlight)" can be derived from formula (A): "number of backlights×target current value×brightness value per milliampere of each backlight=target brightness value", and according to formula (B), the target current value=target brightness value (10%)÷(number of backlights (12)×brightness value per milliampere of each backlight (0.4%))=2 mA. Thus, the terminal device will provide a target current of 2 mA to the six backlights of the first backlight assembly and the six backlights of the second backlight assembly. Since the target current value 2 mA is larger than 1 mA, the light emitted from the six backlights of the first backlight assembly and the six backlights of the second backlight assembly will not flicker, or the brightness of the light will not be unstable; further, it can be guaranteed that the screen of the terminal device can provide brightness according to the target brightness value. In addition, the buffer zone between the first threshold 4.8% and the second threshold 8% ranges from 4.8% to 8%, such that when the target brightness value falls into the buffer zone, the terminal device can remain the original control mode without frequently switching from a single backlight assembly to two backlight assemblies or the other way round.

In an alternative embodiment of the present disclosure, after step 11, the method provided in the present disclosure further includes the following steps: determining a third target current value necessary for the backlights of the first backlight assembly and the backlights of the second backlight assembly to reach the target brightness value together, and providing the third target current value to the backlights of the first backlight assembly and the backlights of the second backlight assembly, when the current brightness value and the target brightness value are both greater than the first threshold. In this way, when the current brightness value and the target brightness value are both greater than the first threshold, there is no need to switch from two backlight assemblies to a single backlight assembly, but the only need is to switch the current value of the two backlight assemblies.

For example, the brightness value of the screen of the terminal device is represented by percentage, the terminal device is supposed to provide current to the backlights of the first backlight assembly and the backlights of the second backlight assembly simultaneously at present, and the rated working current that the terminal device provides for the backlights of the first backlight assembly and the backlights of the second backlight assembly is supposed to range from 1 to 20 mA. When the terminal device provides a current less than 1 mA to the backlights of the first backlight assembly and the backlights of the second backlight assembly, the backlights may flicker, or the brightness of the backlights may be unstable. The number of backlights in the first backlight assembly is six, the number of backlights in the second backlight assembly is six, the brightness per milliampere of each backlight is 0.4%, the brightness value is 20% at present, the current value is 4.16 mA at present, and the target brightness value is 30%. According to formula (A): "number of backlights×target current value×brightness value per milliampere of each backlight=target brightness value", the first threshold=number of backlights (12)×target current value (1 mA)×brightness value per milliampere of each backlight (0.4%)=4.8%, so the first threshold is 4.8%. The current brightness value 20% and the target brightness value 30% are both greater than the first threshold 4.8%, so there is no need to switch from two backlight assemblies to a single backlight assembly, but the only need is to switch the current value of the two backlight assemblies. In order to calculate the third target current value, formula (B): "target current value=target brightness value÷(number of backlights×brightness value per milliampere of each backlight)" can be derived from formula (A): "number of backlights×target current value×brightness value per milliampere of each backlight=target brightness value", and according to formula (B), the target current value=target brightness value (30%)÷(number of backlights (12)×brightness value per milliampere of each backlight (0.4%))=6.25 mA. Thus, the terminal device will provide a target current of 6.25 mA to the six backlights of the first backlight assembly and the six backlights of the second backlight assembly.

In an alternative embodiment of the present disclosure, after step 11, the method provided in the present disclosure further includes the following steps: determining a fourth target current value necessary for the backlights of the first backlight group to reach the target brightness value, and providing the fourth target current value to the backlights of the first backlight assembly, when the current brightness value and the target brightness value are both less than the first threshold and only the backlights of the first backlight assembly are provided with the current. In this way, when the current brightness value and the target brightness value are both less than the first threshold, there is no need to switch from a single backlight assembly to two backlight assemblies, but the only need is to switch the current value supplied to the first backlight assembly.

For example, the brightness value of the screen of the terminal device is represented by percentage, the terminal device is supposed to provide current to the backlights of the first backlight assembly only, and the rated working current that the terminal device provides for the backlights of the first backlight assembly and the backlights of the second backlight assembly is supposed to range from 1 to 20 mA. When the terminal device provides a current less than 1 mA to the backlights of the first backlight assembly and the backlights of the second backlight assembly, the backlights may flicker, or the brightness of the backlights may be unstable. The number of backlights in the first backlight assembly is six, the number of backlights in the second backlight assembly is six, the brightness per milliampere of each backlight is 0.4%, the current brightness value is 3%, the current value is 1.25 mA at present, and the target brightness value is 4%. According to formula (A): "number of backlights×target current value×brightness value per milliampere of each backlight=target brightness value," the first threshold=number of backlights (12)×target current value (1 mA)×brightness value per milliampere of each backlight (0.4%)=4.8%, so the first threshold is 4.8%. The current brightness value 3% and the target brightness value 4% are both less than the first threshold 4.8%, so there is no need to switch from a single backlight assemblies to two backlight assemblies, but the only need is to switch the current value of one backlight assembly. In order to calculate the fourth target current value, formula (B): "target current value=target brightness value÷(number of backlights× brightness value per milliampere of each lamp)" can be derived from formula (A): "number of backlights×target current value×brightness value per milliampere of each backlight=target brightness value," and according to formula (B), the target current value=target brightness value (4%)÷(number of backlights (6)×brightness value per milliampere of each backlight (0.4%))=1.6 mA. Thus, the terminal device will provide a target current of 1.6 mA for the six backlights of the first backlight assembly simultaneously.

In an alternative embodiment of the present disclosure, before step 12, the method provided in the present disclosure further includes the following steps: determining a first total working time of the first backlight assembly and a second total working time of the second backlight assembly respectively; judging whether the first total working time is longer than the second total working time; executing step 12, if the first total working time is longer than the second total working time; stopping current supply to the backlights of the second backlight assembly, determining a fifth target current value necessary for the backlights of the first backlight assembly to reach the target brightness value, and providing the fifth target current value to the backlights of the first backlight assembly, if the first total working time is shorter than or equal to the second total working time. In this way, when the first total working time is longer than the second total working time, which means that the total working time of the first backlight assembly is longer than the total working time of the second backlight assembly, step 12 needs to be executed to stop the current supply to the backlights of the first backlight assembly and execute subsequent operations so as to ensure the relative balance of the working time of the first backlight assembly and that of the second backlight assembly. When the first total working time is not longer than the second total working time, it means that the total working time of the second backlight assembly is longer than the total working time of the first backlight assembly, in order to ensure the balance of the working time of the first backlight assembly and that of the second backlight assembly, the current supply to the backlights of the second backlight assembly needs to be stopped, a fifth target current value necessary for the backlights of the first backlight assembly to reach the target brightness value needs to be determined, and the fifth target current value needs to be provided to the backlights of the first backlight assembly.

Figure 2:
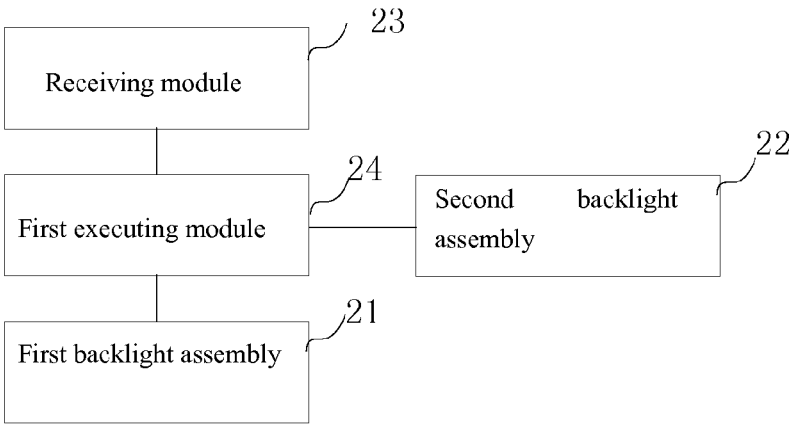
FIG. 2 is a schematic diagram of an apparatus for adjusting brightness of a backlight according to an exemplary embodiment.

FIG. 2 is a schematic diagram of an apparatus for adjusting brightness of a backlight according to an exemplary embodiment. The apparatus for adjusting brightness of a backlight provided in the present disclosure enables a backlight to stably emit light with ultralow brightness. Referring to FIG. 2, the apparatus includes a first backlight assembly 21, a second backlight assembly 22, a receiving module 23 and a first executing module 24. The first backlight assembly 21 and the second backlight assembly 22 both include a plurality of backlights. The receiving module 23 is configured to receive a control instruction to adjust a current brightness value to a target brightness value. The first executing module 24 is configured to stop the current supply to the backlights of the first backlight assembly, determine a first target current value necessary for the backlights of the second backlight assembly to reach the target brightness value, and provide the first target current value to the backlights of the second backlight assembly, when the current brightness value is greater than a first threshold and the target brightness value is less than the first threshold.

In an alternative embodiment of the present disclosure, the apparatus further comprises the following module: a second executing module configured to determine a second target current value necessary for the backlights of the first backlight assembly and the backlights of the second backlight assembly to reach the target brightness value together, and provide the second target current value to the backlights of the first backlight assembly and the backlights of the second backlight assembly, when the current brightness value is less than a second threshold and the target brightness value is greater than the second threshold, the second threshold being greater than or equal to the first threshold.

In an alternative embodiment of the present disclosure, the apparatus further includes the following module: a third executing module configured to determine a third target current value necessary for the backlights of the first backlight assembly and the backlights of the second backlight assembly to reach the target brightness value together, and provide the third target current value to the backlights of the first backlight assembly and the backlights of the second backlight assembly, when the current brightness value and the target brightness value are both greater than the first threshold.

In an alternative embodiment of the present disclosure, the apparatus further includes the following module: a fourth executing module configured to determine a fourth target current value necessary for the backlights of the first backlight assembly to reach the target brightness value, and provide the fourth target current value to the backlights of the first backlight assembly, when the current brightness value and the target brightness value are both less than the first threshold, and only the backlights of the first backlight assembly are provided with the current.

In an alternative embodiment of the present disclosure, the apparatus further includes the following modules: a first determining module configured to determine a first total working time of the first backlight assembly and a second total working time of the second backlight assembly respectively; a first judging module configured to judge whether the first total working time is longer than the second total working time; a fifth executing module configured to execute the first executing module 24 if the first total working time is longer than the second total working time, and to stop the current supply to the backlights of the second backlight assembly, determine a fifth target current value necessary for the backlights of the first backlight assembly to reach the target brightness value, and provide the fifth target current value to the backlights of the first backlight assembly, if the first total working time is shorter than or equal to the second total working time.

With respect to the apparatuses in the above embodiments, the specific manners for performing operations of individual modules therein have been described in detail in the embodiments regarding the methods, which will not be elaborated herein.

Figure 3:
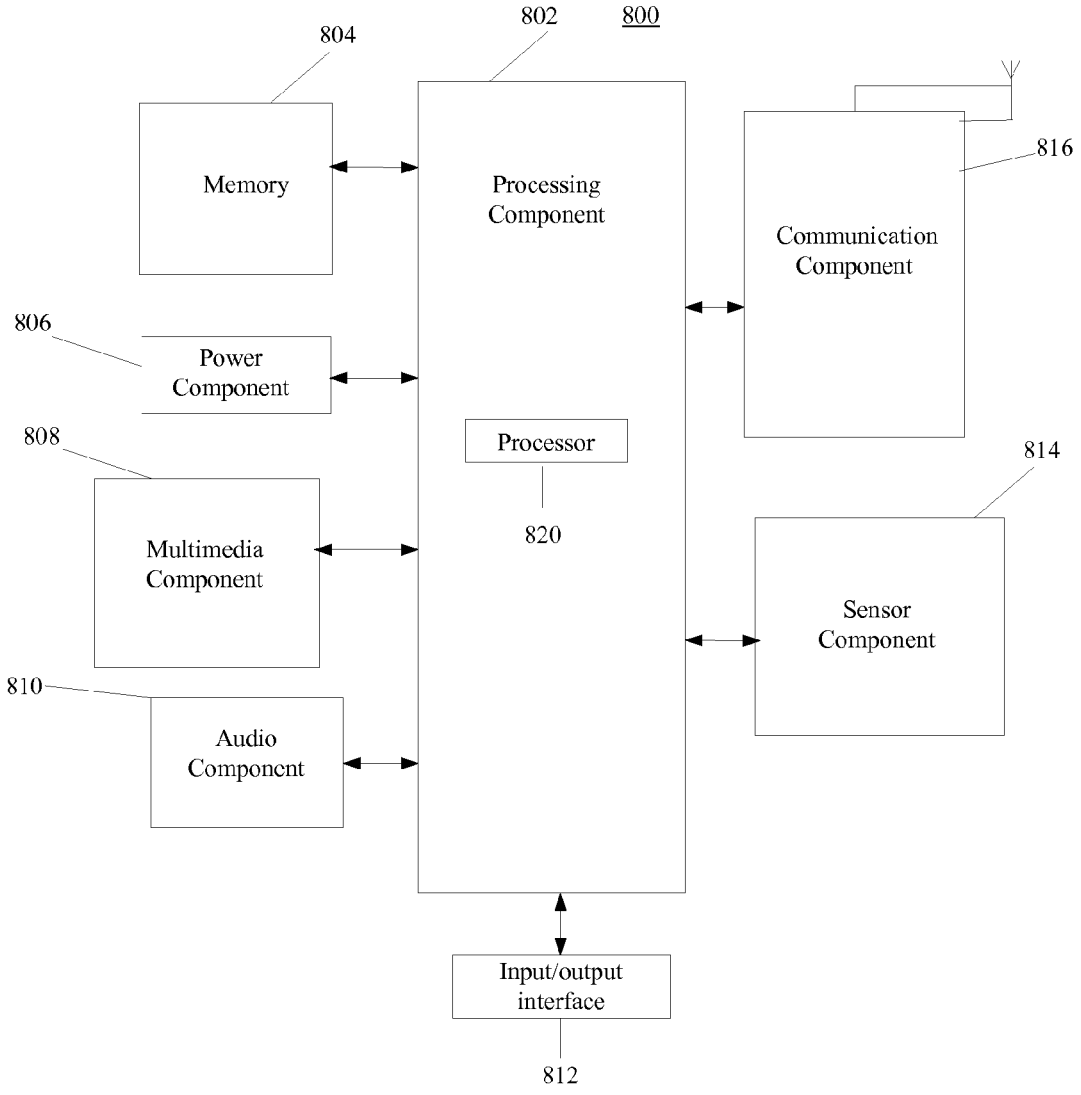
FIG. 3 is a block diagram of a device for adjusting brightness of a backlight according to an exemplary embodiment.

FIG. 3 is a block diagram of a device for adjusting brightness of a backlight 800 according to an exemplary embodiment. For example, the device 800 may be a mobile phone, a computer, a digital broadcast terminal, a messaging device, a gaming console, a tablet, a medical device, exercise equipment, a personal digital assistant, and the like.

Referring to FIG. 3, the device 800 may include one or more of the following components: a processing component 802, a memory 804, a power component 806, a multimedia component 808, an audio component 810, an input/output (I/O) interface 812, a sensor component 814, and a communication component 816.

The processing component 802 typically controls overall operations of the device 800, such as the operations associated with display, telephone calls, data communications, camera operations, and recording operations. The processing component 802 may include one or more processors 820 to execute instructions to perform all or part of the steps in the above described methods. Moreover, the processing component 802 may include one or more modules which facilitate the interaction between the processing component 802 and other components. For instance, the processing component 802 may include a multimedia module to facilitate the interaction between the multimedia component 808 and the processing component 802.

The memory 804 is configured to store various types of data to support the operation of the device 800. Examples of such data include instructions for any applications or methods operated on the device 800, contact data, phonebook data, messages, pictures, videos, etc. The memory 804 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 806 provides power to various components of the device 800. The power component 806 may include a power management system, one or more power sources, and other components associated with the generation, management, and distribution of power for the device 800.

The multimedia component 808 includes a screen providing an output interface between the device 800 and a user. In some embodiments, the screen may include a liquid crystal display (LCD) and a touch panel (TP). If the screen includes a touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a duration and a pressure associated with the touch or swipe operation. In some embodiments, the multimedia component 808 includes a front camera and/or a rear camera. The front camera and the rear camera may receive an external multimedia datum while the device 800 is in an operation mode, such as a photographing mode or a video mode. Each of the front camera and the rear camera may be a fixed optical lens system or have focus and optical zoom capability.

The audio component 810 is configured to output and/or input audio signals. For example, the audio component 810 includes a microphone (MIC) configured to receive an external audio signal when the device 800 is in an operation mode, such as a call mode, a recording mode, and a voice recognition mode. The received audio signal may be further stored in the memory 804 or transmitted via the communication component 816. In some embodiments, the audio component 810 further includes a speaker to output audio signals.

The I/O interface 812 provides an interface between the processing component 802 and peripheral interface modules, such as a keyboard, a click wheel, a button, and the like. The button may be, but is not limited to, a home button, a volume button, a starting button, and a locking button.

The sensor component 814 includes one or more sensors to provide status assessments of various aspects for the device 800. For instance, the sensor component 814 may detect an open/closed status of the device 800, relative positioning of components, e.g., the display and the keypad, of the device 800. The sensor component 814 may also detect a position change of the device 800 or of a component of the device 800, a presence or absence of user contact with the device 800, an orientation or an acceleration/deceleration of the device 800, and a change in temperature of the device 800. The sensor component 814 may include a proximity sensor configured to detect the presence of nearby objects without any physical contact. The sensor component 814 may also include a light sensor, such as a CMOS or CCD image sensor, for use in imaging applications. In some embodiments, the sensor component 814 may also include an accelerometer sensor, a gyroscope sensor, a magnetic sensor, a pressure sensor, or a temperature sensor.

The communication component 816 is configured to facilitate communication, wired or wirelessly, between the device 800 and other devices. The device 800 can access a wireless network based on a communication standard, such as WiFi, 2G, or 3G, or a combination thereof. In one exemplary embodiment, the communication component 816 receives a broadcast signal or broadcast associated information from an external broadcast management system via a broadcast channel. In one exemplary embodiment, the communication component 816 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 800 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, to perform the above described methods.

In exemplary embodiments, there is also provided a non-transitory computer-readable storage medium including instructions, such as a memory 804 including instructions which may be executed by the processor 820 in the device 800 to perform the above-described methods. For example, the non-transitory computer-readable storage medium may be a ROM, a RAM, a CD-ROM, a magnetic tape, a floppy disc, an optical data storage device, and the like.

A non-transitory computer-readable storage medium is provided having stored therein instructions that, when executed by a processor of a terminal device, causes the terminal device to perform a method for adjust brightness of a backlight. The method includes: receiving a control instruction to adjust a current brightness value to a target brightness value; stopping current supply to backlights of the first backlight assembly, determining a first target current value necessary for backlights of the second backlight assembly to reach the target brightness value, and providing the first target current value to backlights of the second backlight assembly, when the current brightness value is greater than a first threshold and the target brightness value is less than the first threshold.

Other embodiments of the invention will be apparent to those skilled in the art from consideration of the specification and practice of the invention disclosed here. This application is intended to cover any variations, uses, or adaptations of the invention which follows the general principles thereof and also includes common knowledge or customary technical means in the art not disclosed in the present disclosure. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A method for adjusting brightness of a backlight in a terminal device, comprising:

receiving a control instruction to adjust a current brightness value to a target brightness value;

stopping current supply to backlights of a first backlight assembly;

determining a first target current value necessary for backlights of a second backlight assembly to reach the target brightness value; and providing the first target current value to the backlights of the second backlight assembly, when the current brightness value is greater than a first threshold and the target brightness value is less than the first threshold, wherein the terminal device comprises the first backlight assembly and the second backlight assembly, each of which comprises a plurality of backlights, and the terminal device supplies current to the backlights of the first backlight assembly and the backlights of the second backlight assembly.

2. The method according to claim 1, wherein after receiving the control instruction, the method further comprises:

determining a second target current value necessary for both the backlights of the first backlight assembly and the backlights of the second backlight assembly to reach the target brightness value; and providing the second target current value to the backlights of the first backlight assembly and the backlights of the second backlight assembly, when the current brightness value is less than a second threshold and the target brightness value is greater than the second threshold, wherein the second threshold is greater than or equal to the first threshold.

3. The method according to claim 1, wherein after receiving the control instruction, the method further comprises:

determining a third target current value necessary for both the backlights of the first backlight assembly and the backlights of the second backlight assembly to reach the target brightness value; and providing the third target current value to the backlights of the first backlight assembly and the backlights of the second backlight assembly, when the current brightness value and the target brightness value are both greater than the first threshold.

4. The method according to claim 1, wherein after receiving the control instruction, the method further comprises:

determining a fourth target current value necessary for the backlights of the first backlight assembly to reach the target brightness value; and providing the fourth target current value to the backlights of the first backlight assembly, when the current brightness value and the target brightness value are both less than the first threshold and only the backlights of the first backlight assembly are provided with current.

5. The method according to claim 1, wherein before stopping the current supply to the backlights of the first backlight assembly, the method further comprises:

determining a first total working time of the first backlight assembly and a second total working time of the second backlight assembly respectively;

judging whether the first total working time is longer than the second total working time;

stopping the current supply to the backlights of the first backlight assembly if the first total working time is longer than the second total working time;

stopping the current supply to the backlights of the second backlight assembly;

determining a fifth target current value necessary for the backlights of the first backlight assembly to reach the target brightness value; and providing the fifth target current value to the backlights of the first backlight assembly, if the first total working time is shorter than or equal to the second total working time.

6. The method according to claim 2, wherein before stopping the current supply to the backlights of the first backlight assembly, the method further comprises:

determining a first total working time of the first backlight assembly and a second total working time of the second backlight assembly respectively;

judging whether the first total working time is longer than the second total working time;

stopping the current supply to the backlights of the first backlight assembly if the first total working time is longer than the second total working time;

stopping the current supply to the backlights of the second backlight assembly;

determining a fifth target current value necessary for the backlights of the first backlight assembly to reach the target brightness value; and providing the fifth target current value to the backlights of the first backlight assembly, if the first total working time is shorter than or equal to the second total working time.

7. The method according to claim 3, wherein before stopping the current supply to the backlights of the first backlight assembly, the method further comprises:

determining a first total working time of the first backlight assembly and a second total working time of the second backlight assembly respectively;

judging whether the first total working time is longer than the second total working time;

stopping the current supply to the backlights of the first backlight assembly if the first total working time is longer than the second total working time;

stopping the current supply to the backlights of the second backlight assembly;

determining a fifth target current value necessary for the backlights of the first backlight assembly to reach the target brightness value; and providing the fifth target current value to the backlights of the first backlight assembly, if the first total working time is shorter than or equal to the second total working time.

8. The method according to claim 4, wherein before stopping the current supply to the backlights of the first backlight assembly, the method further comprises:

determining a first total working time of the first backlight assembly and a second total working time of the second backlight assembly respectively;

judging whether the first total working time is longer than the second total working time;

stopping the current supply to the backlights of the first backlight assembly if the first total working time is longer than the second total working time;

stopping the current supply to the backlights of the second backlight assembly;

determining a fifth target current value necessary for the backlights of the first backlight assembly to reach the target brightness value; and providing the fifth target current value to the backlights of the first backlight assembly, if the first total working time is shorter than or equal to the second total working time.

9. A device for adjusting brightness of a backlight in a terminal device, comprising:

a processor;

a memory configured to store an instruction executable by the processor;

wherein the processor is configured to perform:

receiving a control instruction to adjust a current brightness value to a target brightness value;

stopping current supply to backlights of a first backlight assembly;

determining a first target current value necessary for backlights of a second backlight assembly to reach the target brightness value; and providing the first target current value to the backlights of the second backlight assembly, when the current brightness value is greater than a first threshold and the target brightness value is less than the first threshold, wherein the terminal device comprises the first backlight assembly and the second backlight assembly, each of which comprises a plurality of backlights, and the terminal device supplies current to the backlights of the first backlight assembly and the backlights of the second backlight assembly.

10. The device according to claim 9, wherein after receiving the control instruction, the processor is configured to further perform:

determining a second target current value necessary for both the backlights of the first backlight assembly and the backlights of the second backlight assembly to reach the target brightness value; and providing the second target current value to the backlights of the first backlight assembly and the backlights of the second backlight assembly, when the current brightness value is less than a second threshold and the target brightness value is greater than the second threshold, wherein the second threshold is greater than or equal to the first threshold.

11. The device according to claim 9, wherein after receiving the control instruction, the processor is configured to further perform:

determining a third target current value necessary for both the backlights of the first backlight assembly and the backlights of the second backlight assembly to reach the target brightness value; and providing the third target current value to the backlights of the first backlight assembly and the backlights of the second backlight assembly, when the current brightness value and the target brightness value are both greater than the first threshold.

12. The device according to claim 9, wherein after receiving the control instruction, the processor is configured to further perform:

determining a fourth target current value necessary for the backlights of the first backlight assembly to reach the target brightness value; and providing the fourth target current value to the backlights of the first backlight assembly, when the current brightness value and the target brightness value are both less than the first threshold and only the backlights of the first backlight assembly are provided with current.

13. The device according to claim 9, wherein before stopping the current supply to the backlights of the first backlight assembly, the processor is configured to further perform:

determining a first total working time of the first backlight assembly and a second total working time of the second backlight assembly respectively;

judging whether the first total working time is longer than the second total working time;

stopping the current supply to the backlights of the first backlight assembly if the first total working time is longer than the second total working time;

stopping the current supply to the backlights of the second backlight assembly;

determining a fifth target current value necessary for the backlights of the first backlight assembly to reach the target brightness value; and providing the fifth target current value to the backlights of the first backlight assembly, if the first total working time is shorter than or equal to the second total working time.

14. The device according to claim 10, wherein before stopping the current supply to the backlights of the first backlight assembly, the processor is configured to further perform:

determining a first total working time of the first backlight assembly and a second total working time of the second backlight assembly respectively;

judging whether the first total working time is longer than the second total working time;

stopping the current supply to the backlights of the first backlight assembly if the first total working time is longer than the second total working time;

stopping the current supply to the backlights of the second backlight assembly;

determining a fifth target current value necessary for the backlights of the first backlight assembly to reach the target brightness value; and providing the fifth target current value to the backlights of the first backlight assembly, if the first total working time is shorter than or equal to the second total working time.

15. The device according to claim 11, wherein before stopping the current supply to the backlights of the first backlight assembly, the processor is configured to further perform:

determining a first total working time of the first backlight assembly and a second total working time of the second backlight assembly respectively;

judging whether the first total working time is longer than the second total working time;

stopping the current supply to the backlights of the first backlight assembly if the first total working time is longer than the second total working time;

stopping the current supply to the backlights of the second backlight assembly;

determining a fifth target current value necessary for the backlights of the first backlight assembly to reach the target brightness value; and providing the fifth target current value to the backlights of the first backlight assembly, if the first total working time is shorter than or equal to the second total working time.

16. The device according to claim 12, wherein before stopping the current supply to the backlights of the first backlight assembly, the processor is configured to further perform:

determining a first total working time of the first backlight assembly and a second total working time of the second backlight assembly respectively;

judging whether the first total working time is longer than the second total working time;

stopping the current supply to the backlights of the first backlight assembly if the first total working time is longer than the second total working time;

stopping the current supply to the backlights of the second backlight assembly;

determining a fifth target current value necessary for the backlights of the first backlight assembly to reach the target brightness value; and providing the fifth target current value to the backlights of the first backlight assembly, if the first total working time is shorter than or equal to the second total working time.

17. A non-transitory computer-readable storage medium having stored therein instructions that, when executed by a processor of a terminal device, causes the terminal device to perform a method for adjusting brightness of a backlight, the method comprising:

receiving a control instruction to adjust a current brightness value to a target brightness value;

stopping current supply to backlights of a first backlight assembly;

determining a first target current value necessary for backlights of a second backlight assembly to reach the target brightness value; and providing the first target current value to the backlights of the second backlight assembly, when the current brightness value is greater than a first threshold and the target brightness value is less than the first threshold, wherein the terminal device comprises the first backlight assembly and the second backlight assembly, each of which comprises a plurality of backlights, and the terminal device supplies current to the backlights of the first backlight assembly and the backlights of the second backlight assembly.

* * * * *